US010138673B1

(12) United States Patent
Chapman

(10) Patent No.: US 10,138,673 B1
(45) Date of Patent: Nov. 27, 2018

(54) HINGE MOUNTED ASSEMBLY FOR EXISTING DOOR CONSTRUCTIONS

(71) Applicant: Adam C. Chapman, Chicago, IL (US)

(72) Inventor: Adam C. Chapman, Chicago, IL (US)

( * ) Notice: Subject to any disclaimer, the term of this patent is extended or adjusted under 35 U.S.C. 154(b) by 0 days.

(21) Appl. No.: 14/887,258

(22) Filed: Oct. 19, 2015

(51) Int. Cl.
*E06B 7/36* (2006.01)
*E05D 11/00* (2006.01)

(52) U.S. Cl.
CPC ..... *E06B 7/367* (2013.01); *E05D 11/00* (2013.01); *E05D 11/0054* (2013.01); *E05D 2011/0072* (2013.01)

(58) Field of Classification Search
CPC ..... E06B 7/367; E06B 7/36; Y10T 16/533
See application file for complete search history.

(56) References Cited

U.S. PATENT DOCUMENTS 2,681,479 A * 6/1954 Dixon, Sr. ..... E06B 7/367 49/383
2,694,234 A * 11/1954 Roby ..... E06B 7/367 16/250
2,910,741 A * 11/1959 Dettman ..... E06B 7/367 16/250
2,995,785 A * 8/1961 Hallenbeck ..... E06B 7/367 16/250
4,845,892 A * 7/1989 Pinto ..... E06B 7/16 49/383
4,878,267 A * 11/1989 Roach ..... E06B 7/367 16/250
5,001,862 A * 3/1991 Albenda ..... E06B 7/367 16/251
5,765,311 A * 6/1998 Kapler ..... E06B 7/367 16/250
6,134,839 A * 10/2000 Johansson ..... E06B 7/367 16/258
6,477,809 B1 * 11/2002 Dorner ..... E06B 7/367 49/383
8,505,168 B1 * 8/2013 Chapman ..... E05D 11/00 16/223
2004/0107647 A1 * 6/2004 Salzman ..... E06B 7/367 49/462
2008/0263962 A1 * 10/2008 Wei ..... E06B 7/367 49/462
2010/0162630 A1 * 7/2010 Shim ..... E06B 7/367 49/383
2010/0257788 A1 * 10/2010 McRoskey ..... E06B 7/367 49/383
2011/0302845 A1 * 12/2011 McRoskey ..... E06B 7/367 49/460

(Continued)

*Primary Examiner* — Justin Rephann
(74) *Attorney, Agent, or Firm* — Dillis V. Allen, Esq.

(57) ABSTRACT

A hinge mounted assembly for existing door constructions for supporting articles between a door and a door jamb in a door construction that has upper and lower hinges; including a first "U" shaped bracket mounted above one of the hinges to prevent downward movement of the hinge mounted assembly, and a second "U" shaped bracket mounted below one of the hinges to prevent upward movement of the hinge mounted assembly, and a vertically running support rod connected to the two brackets, such that it abuts closely against the protruding portion of both hinges on the back side of the door, to prevent lateral movement of the hinge mounted assembly.

14 Claims, 8 Drawing Sheets

(56) References Cited

U.S. PATENT DOCUMENTS

| | | | | |
|---|---|---|---|---|
| 2012/0210648 | A1* | 8/2012 | Yang | E06B 7/367<br>49/383 |
| 2015/0152680 | A1* | 6/2015 | Izod | E06B 7/367<br>49/462 |

* cited by examiner

HINGE MOUNTED ASSEMBLY FOR EXISTING DOOR CONSTRUCTIONS

BACKGROUND OF THE PRESENT INVENTION

Child-proof door jamb covers have been provided in the past for preventing pinching a child's fingers in door jambs as the doors open and close. Many village, city, and county ordinances in communities in the United States require such door jamb covers to ensure the safety of our children. Unfortunately, the existing door jamb products require drilling and screwing into existing doors and associated jambs. Landlords have lease provisions that prohibit damage to the leased property by the tenant and thus prevent invasive door add-on products that require drilled-in screws and/or damage-causing strong adhesives. To date, no child-safety finger guard mounting system has been introduced that is sturdy, easy to install, removable, and requires no screws (nor screwdrivers), nor damaging adhesives. The existence of a fast, simple and effective product that incorporates a removable, no-tools-required mounting approach will result in an increased number of installed finger guards, greatly improving the safety of many.

Hinge pin brackets have been provided in the past, such as shown in the Buckelew; U.S. Pat. No. 6,658,696.

There are five U.S. Pat. Nos. 6,134,839; 5,765,311; 5,778,601; 6,434,888, and 8,505,168 that show mounted brackets, and these require a screwdriver, screws and, in some cases, a drill, to be used in attaching an elongated protective plate designed to cover the dangerous gap between the door and the door jamb. Unfortunately, the need for a screwdriver and screws is a complexity that deters many people from using these solutions. For one, landlords have lease provisions that prohibit damage and alterations to leased property by tenants. Secondly, installing screws into the door and door jamb requires more physical strength and know-how than many people possess. Finally, screw sizes vary and often a correctly-sized screwdriver is not readily available. These obstacles collectively prevent the installation of products that would protect building owners' and tenants' children as well as their guests' children. An improved child-safety door guard design should enable mounting on elongated spring-biased child-safety protective plate to the door by using a mounting assembly that does not damage the door, and does not require tools for installation.

SUMMARY OF THE PRESENT INVENTION

In accordance with the present invention, a hinge mounted assembly for existing door constructions for supporting articles between a door and a door jam in a door is provided that has upper and lower hinges; including a first "U" shaped bracket mounted above one of the hinges to prevent downward movement of the hinge mounted assembly, and a second "U" shaped bracket mounted below one of the hinges to prevent upward movement of the hinge mounted assembly, and a vertically running support rod connected to the two brackets, such that it abuts closely against the protruding portion of both hinges on the back side of the door, to prevent lateral movement of the hinge mounted assembly.

No tools are necessary because the vertically elongated mounting assembly does no damage to the multi-hinged door upon which it is installed. It makes use of the unique, available features of an existing hinge-mounted door to support the bracket assembly, reducing part complexity, eliminating the need for holes in the door, and requiring no installation tools (e.g., no screwdrivers, no drills), while providing higher load support over an extended vertical distance along the front-side and/or the back-side of the door. This assembly can support a variety of door products, including a child-safety door guard on both the front-side and back-side of the door, as well as a swinging arm towel rack on both the front-side and back-side of the door.

To overcome the indentified issues of existing products, the present invention provides a no-tools-required method for attaching add-on products to extended vertical mounting surfaces on the lower area of hinged-doors. The present invention involves a mounting assembly for a multi-hinged door, allowing finger guards, coat racks or towel rods to be affixed to the front-side or back-side of a door in a manner that requires no drilling of holes, no installation tools, do damaging paint-stripping adhesives, does not require specific door height, adapts by its design to varying door hinge vertical lengths, and adapts by its design to various door hinge locations. The mounting system is also notable for being easily removable, returning the door to its original condition when uninstalled.

It is a primary object of the present invention to provide a vertically elongated, door-mounted bracket assembly that is non-damaging, requires no tools to install, and connects all parts together in a firmly-fixed, immovable system uniquely adapted to exploit existing hardware in order to support itself securely along an elongated vertical surface of the door.

Another object of the present invention is to provide a mounting bracket system which spans the vertical distance between at least two door hinges, providing a non-door-damaging mountable surface over an extended length along the frontside and/or backside of the door.

Another object of the present invention is to provide a mounting bracket system which minimizes size and complexity in material production costs, thus minimizing the installation complexity to mount vertically extending add-ons to the frontside and/or backside of hinged doors (the described "U" brackets, while adapted specifically to work within the mounting system on a multi-hinged door, are deliberately simplified so that they can be individually cut from a single metal extrusion).

Another object of the present invention is to provide a mounting bracket system which employ brackets that sit fully above or below a given door hinge, removing the need for individual brackets to transverse varying vertically elongated hinge sizes, and also eliminating the need for a door hinge to have some minimal amount of vertical size in order for the mounting system to have complete stability, thus better ensuring universal adaptability to doors with very small and/or very large hinges, while using less costly, simplified parts.

Another object of the present invention is to provide a vertically-elongated mounting system which is adapted by design to span the varying vertical distances between two separate hinges on existing installed doors, in order to create a very lengthy vertical mounting surface.

Another object of the present invention is to provide a mounting system which cares not about the varying heights of doors, as no part of the mounting system needs to reach to the top of the door.

Another object of the present invention is to provide a mounting bracket system which installs easily on both left-hung and right-hung hinged doors.

Another object of the present invention is to provide a vertically-elongated mounting bracket system which remains securely fixed in its installed place, during all times of installed operation, through both open and closed door swing movement positions, even if a child applies force up or down on it.

According to the present invention, a hinged-door-mounted bracket system is provided that is securely attached to door. It is not destructive to the door and offers increased load-bearing values over an extended vertical area on the door, and is simple to install, requiring no tools. Toward these ends, a pair of generally "U" shaped brackets (with specific widths to fit snuggly upon the end of the door, with specific thinness so as not to interfere with door functioning, with specific height for stability and with specific fastener points, for connection to the other parts in the vertically-elongated mounting system are placed upon the hinged-side of the door, a first bracket placed just above a door hinge keeps the bracket, and thus the rest of the mounting assembly, from sliding down the door, while taking advantage of the hinge's load bearing capacity, and a second bracket placed just below a separate, nearby door hinge (this serves to restrict the mounting assembly from sliding upward on the door). A vertically running support rod is attached (having specific length at least as long as the vertical distance between the two separate door hinge plates) to both brackets via connector points, specifically on the back-side of the hinged door, with the support rod abutted closely against the protruding portion of both door hinges on the backside of the door. All mounting system parts, only when connected to each other in this manner and in these locations, are thus rendered fixed upon the door, each immovable, unable to slide in any direction, allowing a variety of door add-ons to be affixed at various continuous vertical locations along the front or the back of the door. The unique design allows all of this without requiring the use of installation tools.

Other objects and advantages of the present invention will appear more clearly from the following detailed description.

DETAILED DESCRIPTION OF THE PREFERRED EMBODIMENT

Figure 1:
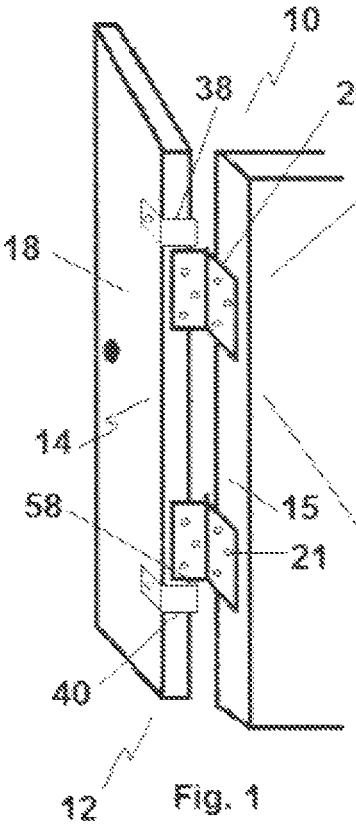
FIG. 1 is a perspective view of an open door with one form of the present hinge mounted assembly for existing door constructions according to the present invention.

Referring to the drawings and particularly FIGS. 1 to 7, a hinge mount assembly for existing door constructions according to the present invention, is illustrated by the reference numeral 10 and is seen to include a conventional door construction 12 and an hinge mounted assembly 14 according to the present invention shown in FIGS. 1, 2, 3, 5, 6 and 7 mounted on the door construction 12.

The door construction 12 is seen to include a vertical jamb frame 15, a rectangular pivotal door 18, and an upper hinge assembly 20 and a lower hinge assembly 21.

Figure 5:
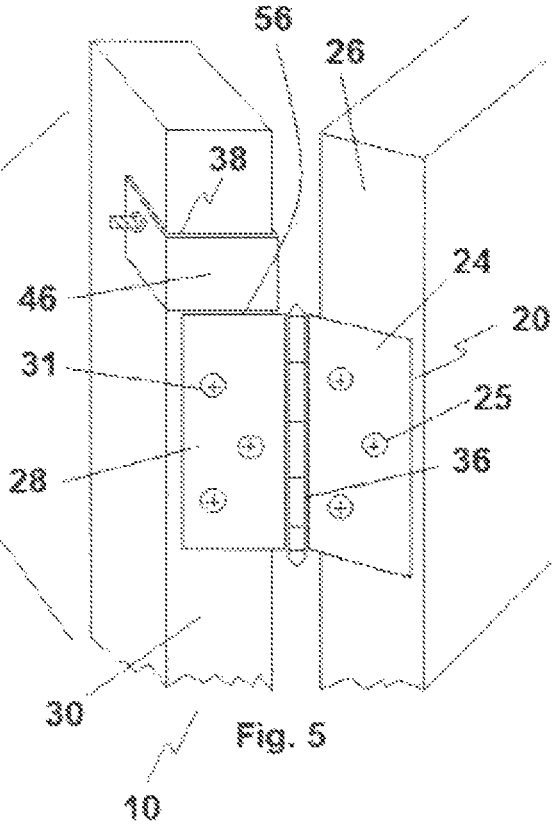
FIG. 5 is a fragmentary section of the upper hinge assembly and the upper bracket of the present hinge mounted assembly for existing door constructions shown mounted in position with the door of the door construction open.
Figure 2:
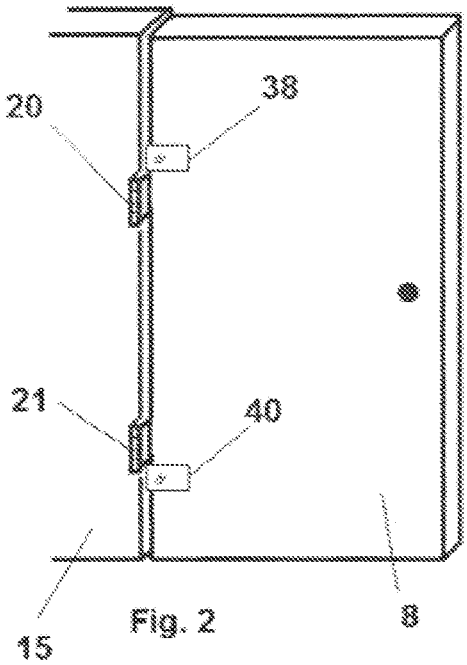
FIG. 2 is a door construction assembly with the present hinge mounted assembly for existing door constructions mounted in position and viewed from the outside of the door with the door closed.
Figure 3:
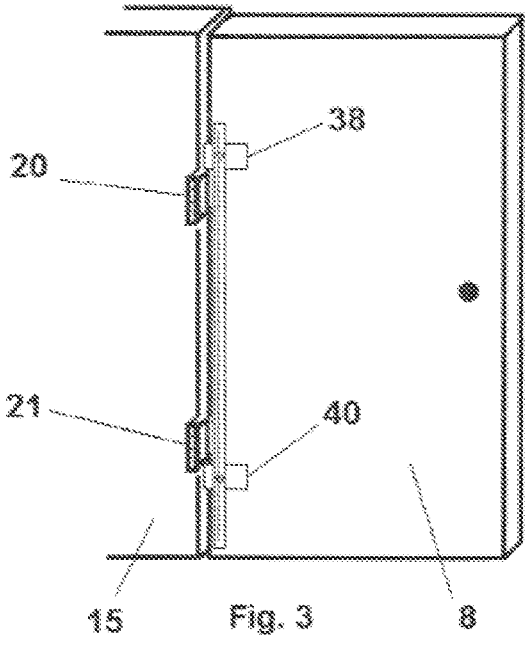
FIG. 3 is a view similar to FIG. 2 of the present hinge mounted assembly for existing door constructions with the door open and viewed from the inside of the door constructions with the vertically running support rod attached.

As seen in FIG. 5 more clearly, each of the hinge assemblies 20 and 21 is identical and includes a rectangular jamb plate 24 mounted by three screws 25 to jamb frame portion 26, a door mounted rectangular plate 28 mounted to door edge surface 30 by three screws 31, and a pin hinge assembly 36.

The hinge mount assembly 14 includes an upper U-shaped bracket 38 mounted to the door 18 and a lower U-shaped bracket 40 also mounted to the door 18.

Figure 4:
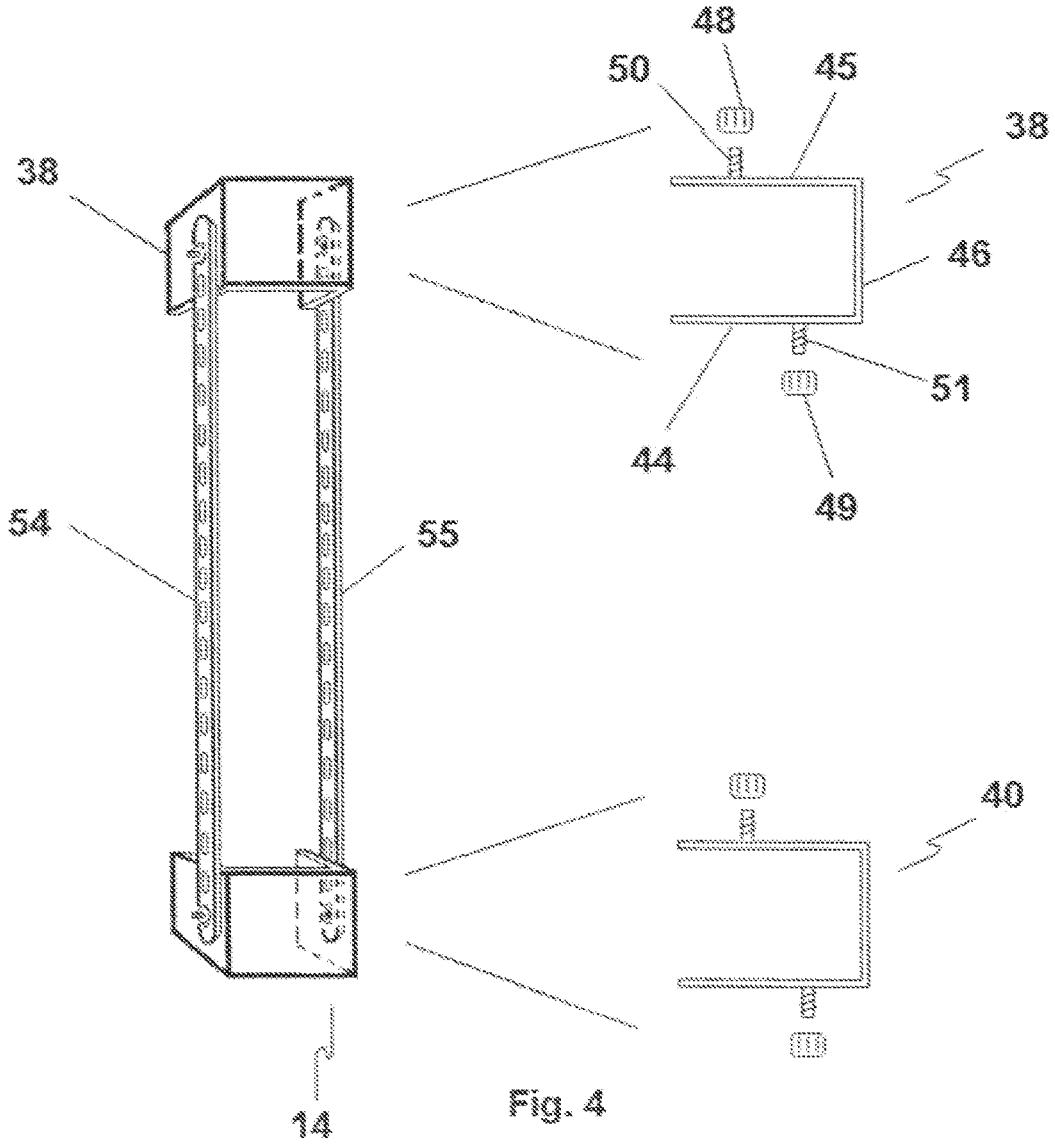
FIG. 4 is an exploded sub-assembly of the present hinge mounted assembly for existing door constructions with the upper and lower brackets exploded away.
Figure 6:
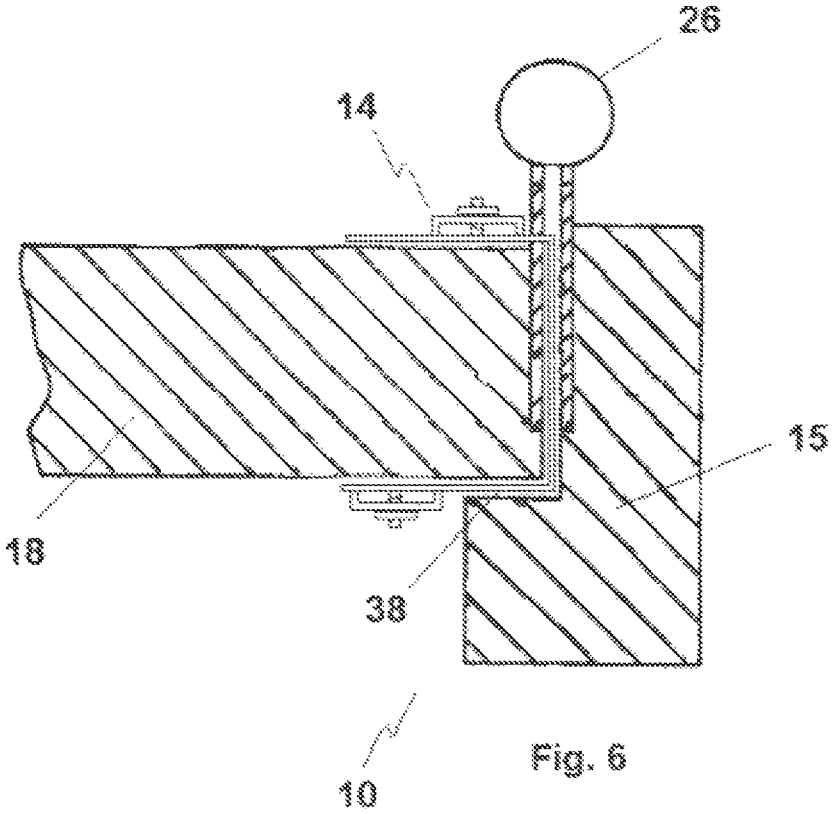
FIG. 6 is a horizontal cross section looking downwardly above the upper hinge in FIGS. 1, 2, 3, and 5, with the door closed according to the present hinge mounted assembly for existing door constructions.
Figure 7:
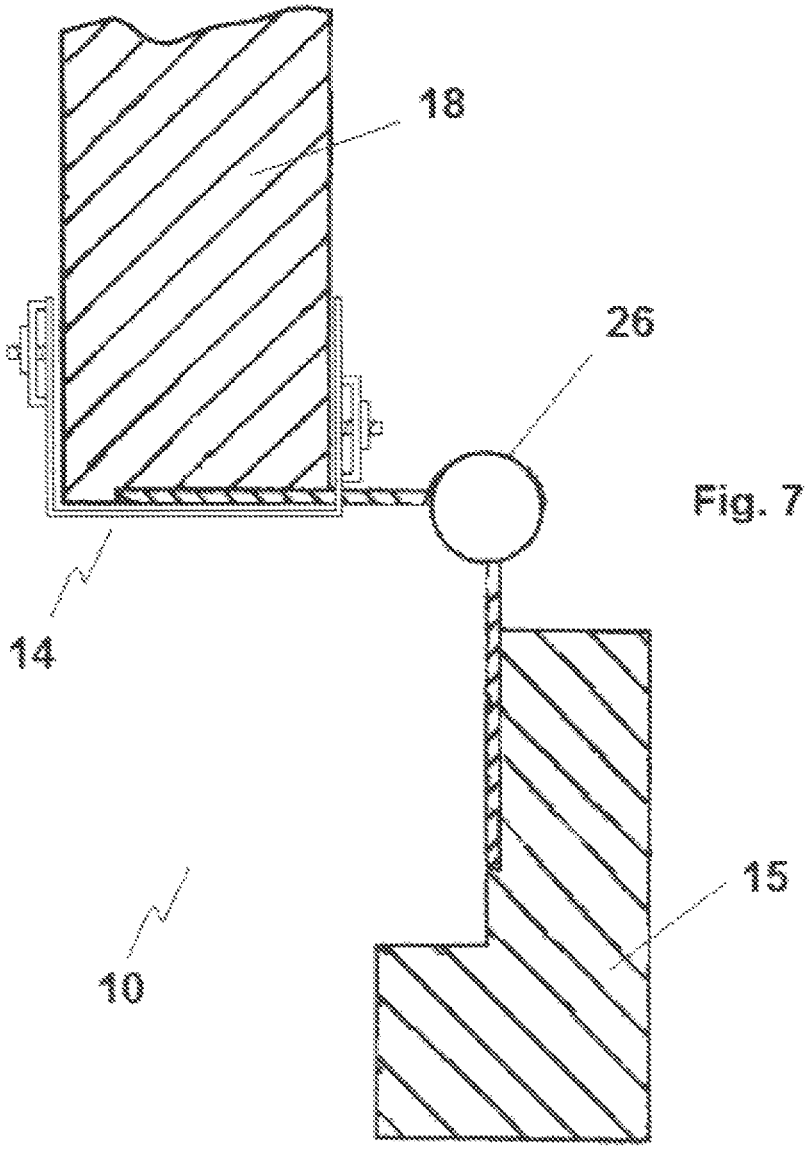
FIG. 7 is a horizontal cross-section similar to FIG. 6 with the door open according to the present hinge mounted assembly for existing door constructions.

As seen in FIG. 4, the upper bracket 38 and the lower bracket 40 are identical and each includes flat leg portions 44 and 45 connected by a flat U-shaped portion 46. Threaded studs 50 and 51 are welded to legs 44 and 45 and receive thumb screw nuts 48 and 49 designed so that the brackets 38 and 40 may be attached to the door 18 without the use of any screwdrivers, wrenches or other tools.

The upper and lower brackets 38 and 40 can be extruded and severed after extrusion to reduce the cost thereof.

The legs 44 and 45 are spaced apart to fit standard size doors.

Indoor doors are generally slightly narrower than exterior commercial doors, so that the brackets 38 and 40 may be commercially packaged into two sizes to accommodate those two different standard doors.

As seen in FIG. 4, the upper and lower brackets 38 and 40 are spaced apart and connected together by apertured strip struts 54 and 55 that are fastened to the upper and lower brackets by the thumb screws 50 and 51. These struts 54 and 55 serve to unitize the hinge mount assembly 14 together as a unit and also serve so that the hinge mount assembly 14 can be force transferred between upper bracket 38 and lower bracket 40 in either direction. The apertures in the struts 54 and 55 can receive a variety of hangers and connectors.

Note that the upper bracket in FIGS. 1, 2, 3, 6 and 7 engages upper surface of hinge plate 28 of hinge 20, without being fixedly connected to the hinge 20 and therefore resist downward movement of bracket 38, as well as the entire hinge mount assembly 14. In this manner the hinge mount assembly 14 and any object connected to the hinge mount assembly 14 is supported vertically on the hinge mount assembly 14 and indirectly by the door construction 12.

In this regard note in FIG. 5 that bight portion 46 of upper hinge 20 engages upper edge 56 of hinge plate 20, without being attached to the hinge.

As seen in FIGS. 1, 2, 3, 13, 14 and 15, lower bracket 40 is mounted below the lower hinge 21 and engages lower surface 58 of lower hinge 21 to resist upward movement of the entire hinge mount assembly 14, and thus prevent the hinge mount assembly 14 from sliding upwardly, or anything supported in the hinge mount assembly 14 from sliding upwardly.

Figure 8:
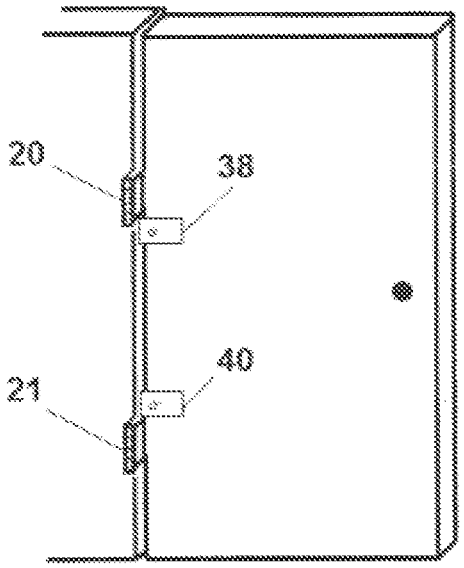
FIGS. 8 and 9 are front and rear views of a door construction with the present hinge mounted assembly for existing door constructions mounted underneath the upper hinge and on top of the lower hinge according to another embodiment of the present invention.
Figure 9:
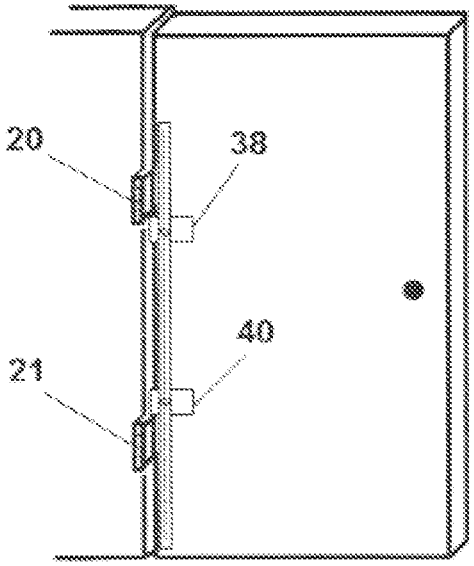

As seen in FIGS. 8 and 9, upper hinge bracket 38 may be mounted below upper hinge 20 instead of above it, and lower hinge bracket 40 is mounted in the variation above the lower hinge 21, so the direction of the upper and lower brackets is reverse.

As seen in FIGS. 3, 6, 7, 9 and 13, a support rod connected to the two u-brackets abuts closely against the protruding portion of the hinges on the back side of the door, thus preventing the hinge mount assembly from sliding laterally off of the edge of the door.

Figure 10:
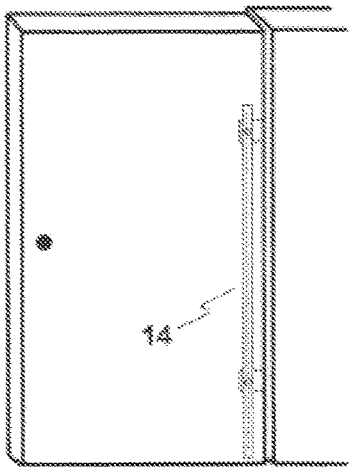
FIG. 10 is an inside view of a door construction without the door jamb safety panel in position, of the door construction according to the hinge mounted assembly for existing door constructions.
Figure 11:
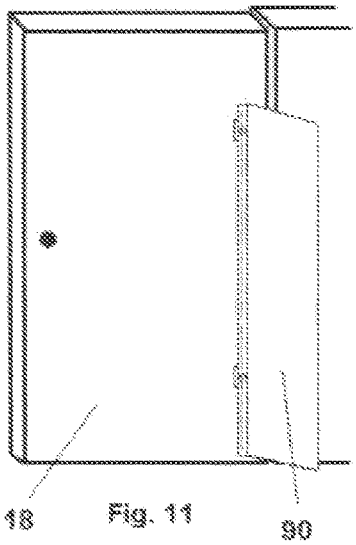
FIG. 11 is a similar view to FIG. 10 with a door jamb safety panel suspended from the present hinge mounted assembly for existing door constructions in its illustrated position.
Figure 12:
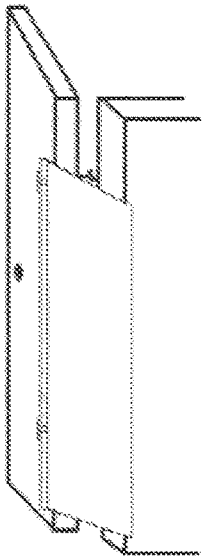
FIG. 12 is a view similar to FIG. 11 with the door of the door construction open according the present hinge mounted assembly for existing door constructions.

In FIGS. 10, 11 and 12, a jamb protector assembly 90 is shown mounted on a hinge mounted assembly 14 according to the present invention on the outside of door panel 18, on the front side of the door.

Figure 13:
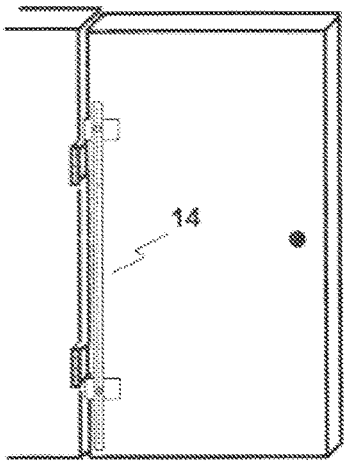
FIG. 13 is an outside view of an open door construction with the present hinge mounted assembly for existing door constructions illustrated in position.
Figure 14:
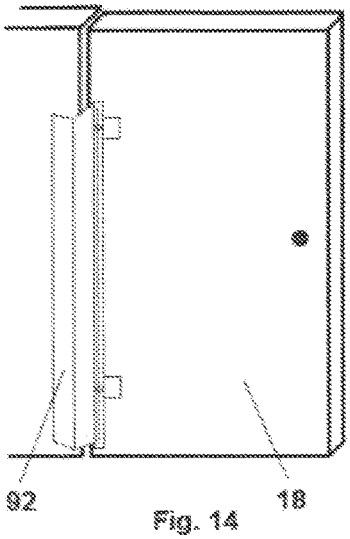
FIG. 14 is a view similar to FIG. 13, from the outside of the door, with the door open, and showing an exemplary door jamb safety panel in position according to the present hinge mounted assembly for existing door constructions.
Figure 15:
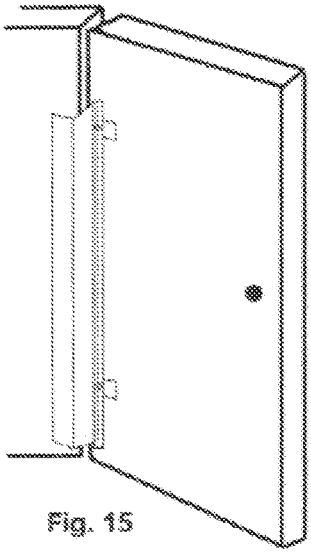
FIG. 15 is a view similar to FIG. 14 with the door of the door construction partly open according to the present hinge mounted assembly for existing door constructions.

In FIGS. 13, 14 and 15, a jamb protector assembly 92 is shown mounted on a hinge mounted assembly 14 according to the present invention on the outside of door panel 18, on the back side of the door.

The invention claimed is:

1. A door hinge mounted assembly for existing door constructions, comprising: a generally planar door having a front side and a back side including an upper hinge assembly and a lower hinge assembly each having a top edge and a bottom edge, a hinge mounted assembly including a first bracket adjacent one of the upper hinge assembly and the lower hinge assembly and engaging one of the top edges of one of the upper hinge assembly and the lower hinge assembly to prevent downward movement of the hinge mounted assembly relative to the door, a second bracket adjacent to and engaging the other of the hinge assemblies, and a support rod between the first and the second bracket, said first and second brackets being separate from the upper and lower hinge assemblies.

2. The door hinge mounted assembly for existing door constructions as defined in claim 1, wherein the second bracket is mounted below the other of the hinge assemblies.

3. The door hinge mounted assembly for existing door constructions as defined in claim 1, wherein the first bracket is "U" shaped having a first leg on one side of the door, a second leg on another side of the door and a connecting portion connecting the legs and engaging an edge of the door.

4. The door hinge mounted assembly for existing door constructions as defined in claim 1, wherein the second bracket is "U" shaped having a first leg on one side of the door, a second leg on another side of the door and a connection connecting the legs and engaging an edge of the door.

5. The door hinge mounted assembly for existing door constructions as defined in claim 1, wherein a strut extends between the upper bracket and the lower bracket and includes thumb screw nut connectors to both the upper bracket and the lower bracket, engaging said protruding portion of the hinge assemblies to prevent lateral movement of the hinge mount assembly.

6. The door hinge mounted assembly for existing door constructions as defined in claim 1, wherein the first bracket is "U" shaped having a first leg on one side of the door, a second leg on another side of the door and a bight portion connecting the legs and engaging an edge of the door, and wherein the second bracket is "U" shaped having a first leg on one side of the door, a second leg on another side of the door and a connecting portion connecting the legs and engaging an edge of the door.

7. The door hinge mounted assembly for existing door constructions as defined in claim 1, wherein the second bracket is mounted below one of the lower hinge assembly and the lower hinge assembly and engaging a surface of one of the lower hinge assembly and the upper hinge assembly to prevent upward movement of the hinge mount assembly wherein the first bracket is "U" shaped having a first leg on one side of the door, a second leg on another side of the door and a bight portion connecting the legs and engaging an edge of the door, wherein the second bracket is "U" shaped having a first leg on one side of the door, a second leg on another side of the door and a connecting portion connecting the legs and engaging an edge of the door.

8. The door hinge mounted assembly for existing door constructions as defined in claim 1, wherein the support rod between the upper bracket and the lower bracket includes thumb screw nut connectors on the upper bracket and the lower bracket.

9. A door hinge mounted assembly for existing door constructions, comprising: a generally planar door including an upper hinge assembly and a lower hinge assembly each having a top edge and a bottom edge, a hinge mounted assembly including a first bracket adjacent one of the upper hinge assembly and the lower hinge assembly, a second bracket mounted below one of the upper hinge assembly and the lower hinge assembly and engaging one of the bottom edges of one of the upper hinge assembly and the lower hinge assembly to prevent upward movement of the hinge mounted assembly, and a support rod between the first bracket and the second bracket, said first and second brackets being separate from the upper and lower hinge assemblies.

10. The door hinge mounted assembly for existing door constructions as defined in claim 9, wherein the second bracket is mounted below the lower hinge assembly and the first bracket engaging a surface of the upper hinge assembly to prevent downward movement of the hinge mounted assembly.

11. The door hinge mounted assembly for existing door constructions as defined in claim 9, wherein the first bracket is "U" shaped having a first leg on one side of the door, a second leg on another side of the door and a connecting portion connecting the legs and engaging an edge of the door.

12. The door hinge mounted assembly for existing door constructions as defined in claim 9, wherein the second bracket is "U" shaped having a first leg on one side of the door, a second leg on another side of the door and a connecting portion connecting the legs and engaging an edge of the door.

13. A method of mounting a door hinge mounted assembly on a door construction having an upper hinge and a lower hinge each having a top edge and a bottom edge, and each connected to the door, wherein the door hinge mounted assembly includes an upper bracket, a lower bracket, and a support member between the upper bracket and the lower bracket, including the steps of mounting the upper bracket above the upper hinge and engaging a transverse surface of the upper bracket to one of said upper edge and lower edge of the upper hinge to prevent downward movement of the hinge mounted assembly, and mounting the lower bracket to the door.

14. The method of mounting a door hinge mounted assembly on a door construction as defined in claim 13, including wherein the step of mounting the lower bracket to the door includes mounting the lower bracket below the lower hinge and engaging the lower hinge to prevent upward movement of the hinge mount assembly.

* * * * *